US005936517A

United States Patent [19]

Yeh

[11] Patent Number: 5,936,517

[45] Date of Patent: Aug. 10, 1999

[54] SYSTEM TO MINIMIZE THE DISTANCE BETWEEN TRAINS

[76] Inventor: Show-Way Yeh, 21701 Stevens Creek Blvd., Cupertino, Calif. 95014

[21] Appl. No.: 09/109,828

[22] Filed: Jul. 3, 1998

[51] Int. Cl.[6] ..... B60Q 1/00

[52] U.S. Cl. ..... 340/435; 340/903; 246/4; 246/26; 246/168; 246/187 C; 246/182 B; 246/122 R; 701/19; 701/301

[58] Field of Search ..... 340/435, 436, 340/903, 988, 992, 993, 994; 246/26, 168, 187 C, 182 B, 122 R, 4; 701/19, 301

[56] References Cited

U.S. PATENT DOCUMENTS

| | | | |
|---|---|---|---|
| 5,467,945 | 11/1995 | Kubota et al. | 246/26 |
| 5,757,291 | 5/1998 | Kull | 340/988 |
| 5,803,411 | 9/1998 | Ackerman et al. | 246/169 R |
| 5,813,635 | 9/1998 | Fernandez | 246/168 |

*Primary Examiner*—Nina Tong

[57] ABSTRACT

Each train detects its location, velocity, and the time it will spend to pass the next bifurcation, joint, and intersection, respectively, and sends the information periodically to the trains that are or will be behind the train. The controller of each bifurcation, joint, and intersection, respectively, having mechanical movement sends the connection status of the track to the trains about to pass it. Then, receiving a message, a train can determine if it may hit its front train if its front train stops abruptly and if it may pass the bifurcation, the joint, and the intersection, respectively, before the track there has been connected for it. If yes, the train decelerates to stop to avoid possible disasters. So that the distance between every two consecutive trains can be minimized and different kinds of trains may share the same railroad. Hence, some railroads may be saved. Furthermore, multiple trains and buses can be arranged to arrive at or depart from a station at close moments of time and each bus stops at small number of stops. Hence significantly shorten the time each passenger spends on commuting.

2 Claims, 8 Drawing Sheets

SYSTEM TO MINIMIZE THE DISTANCE BETWEEN TRAINS

FIELD OF INVENTION

The present invention relates to minimizing the distance between consecutive trains while improving the safety so that the capacity of the railroad can be significantly improved, different train systems may share the same railroad, and trains and buses can be arranged to reduce the time that each passenger spends on commuting.

BACKGROUND

Figure 1A:
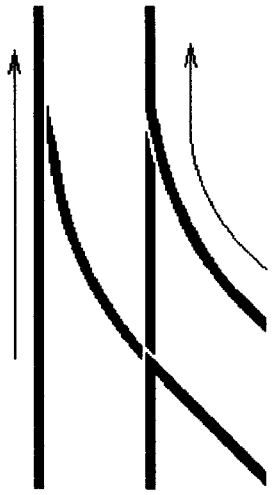
Figure 1B:
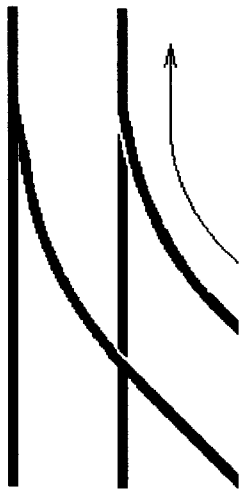
Figure 1C:
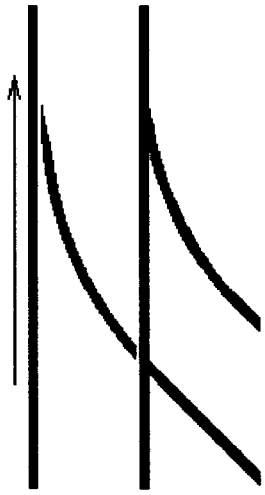

The distance between two consecutive trains is set to guarantee that the rear will not hit the front even if the front stops abnormally and abruptly. Some track joints, as shown in FIG. 1A, do not need to change the track connection when two trains on different tracks get on the same track, Others, as shown in FIGS. 1B and 1C, do. Each bifurcation needs to change the track connection when two trains on the same track get on different tracks. If a two way railroad has two way branches, it is difficult to avoid railroad intersections that may or may need to change the track connection. For those cases that, after a train passes, the track connection needs to be changed for the next train to pass, the distance between two consecutive trains is set to guarantee that the track connection is changed correctly before the rear passes the joint, the bifurcation, or the intersection, respectively. If the track cannot change the connection correctly in time, the train can stop before the joint, the bifurcation, or the intersection, respectively. Since there are not good means to determine how long the distance between two consecutive trains is enough, the distance is usually set to be much longer than enough. This limits the capacity of the railroad.

OBJECTS AND ADVANTAGES

The objects and advantages of the present invention are:

- to minimize the distance between every two consecutive trains;
- to improve the frequency of the trains significantly and to achieve the maximum capacity of the railroad;
- to let different train systems, for example, long distance high speed trains and rapid transit trains, share the same railroad;
- to save some railroads;
- to arrange multiple trains and multiple buses to arrive and to depart from a train station at very close moments of time to significantly reduce the time each commuter spends;
- to let each train know what, where, and how the trains in front intend to run and how the bifurcation, the joint, and the intersection, respectively, that the train is about to pass intends to connect the track so that the train can take actions to avoid possible accidents.

DRAWING FIGURES

FIGS. 1A to 1C: The track at a joint with and without mechanical movement.

Figure 2:
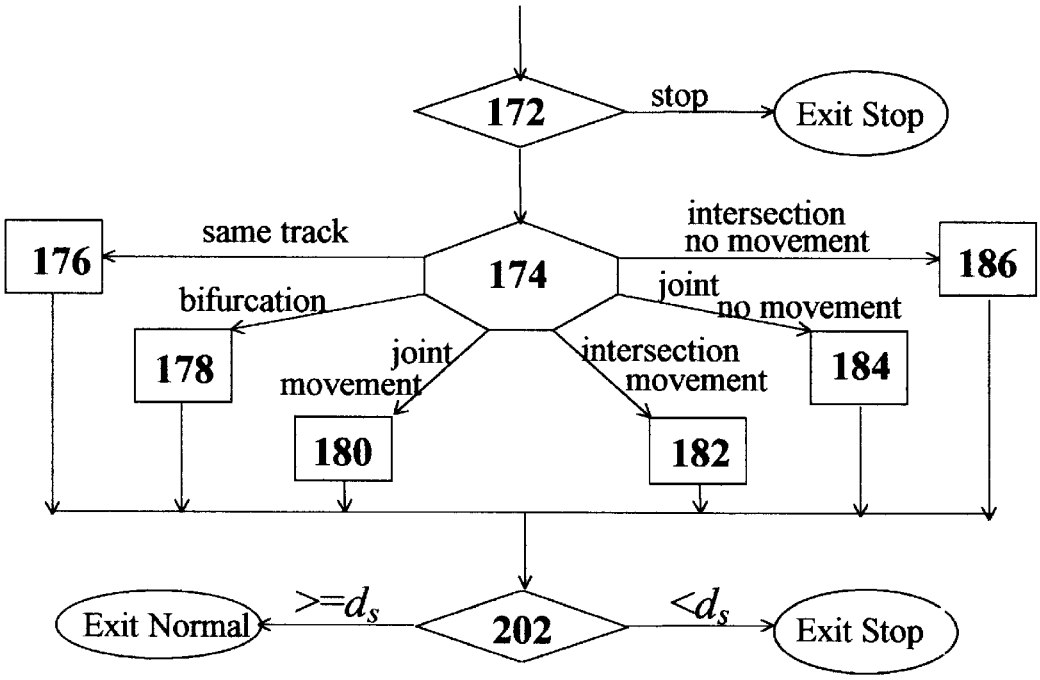

FIG. 2: The process when a train receives a message from its front train.

FIGS. 3A to 3C: Minimum distance between two consecutive trains.

Figure 4:
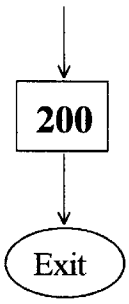

FIG. 4: The process when a train receives a message from its front train while the two trains are running and will run on the same track in the near future.

FIGS. 5A to 5E: Minimum distance between two consecutive trains when they are about to pass a bifurcation.

Figure 6:
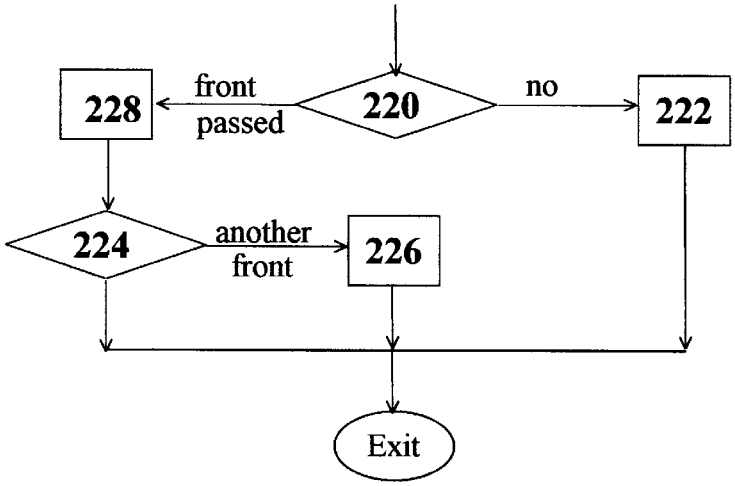

FIG. 6: The process when a train receives a message from its front train while the train is about to pass a bifurcation.

FIGS. 7A to 7D: Minimum distance between two consecutive trains when they are about to pass a joint that has mechanical movement.

Figure 8:
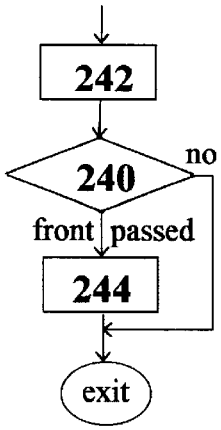

FIG. 8: The process when a train receives a message from its front train while the train is about to pass a joint that has mechanical movement.

Figure 9:
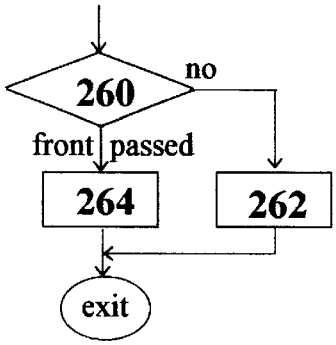

FIG. 9: The process when a train receives a message from its front train while the train is about to pass an intersection that has mechanical movement.

FIGS. 10A to 10C: Minimum distance between two consecutive trains when they are about to pass a joint that has not mechanical movement while the front train stops at the joint.

FIGS. 11A to 11C: Minimum distance between two consecutive trains when they are about to pass a joint that has not mechanical movement while the front train stops after the joint.

Figure 12:
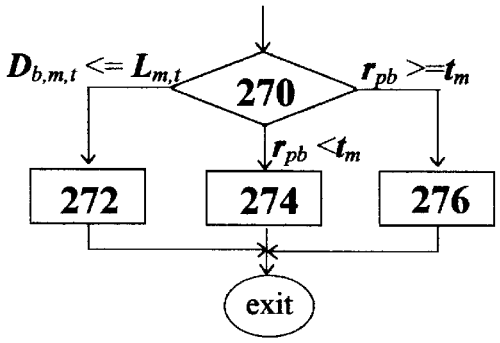

FIG. 12: The process when a train receives a message from its front train while the train is about to pass a joint that has not mechanical movement.

Figure 13:
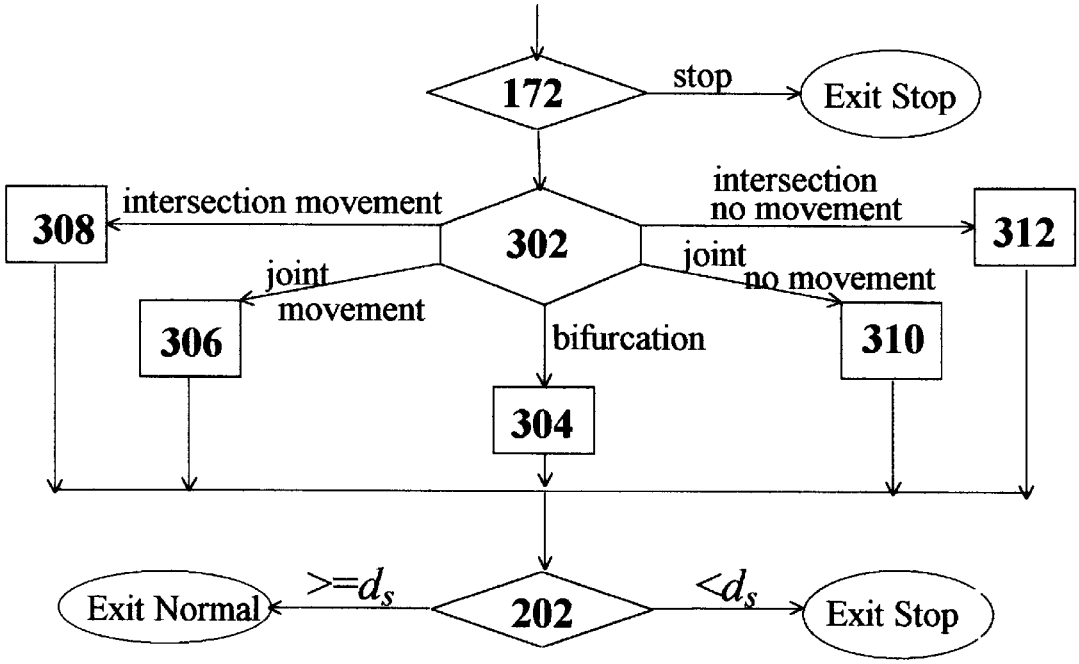

FIG. 13: The process when a train receives the message that the front train just passed the bifurcation, the joint, or the intersection, respectively, that the train is about to pass.

Figure 14:
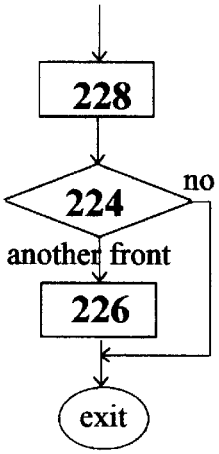

FIG. 14: The process when a train receives the message that the front train just passed the bifurcation or the confirmation message of the track connection at the bifurcation.

Figure 15:
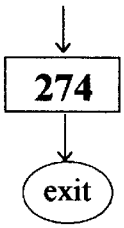

FIG. 15: The process when a train receives the message that the front train just passed the joint having not mechanical movement or the confirmation message of the track connection at the bifurcation.

Figure 16:
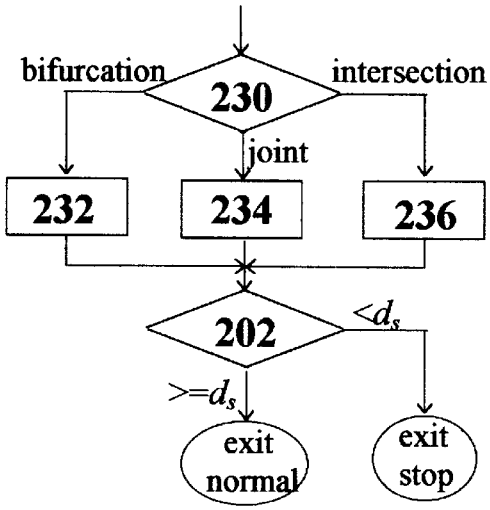

FIG. 16: The process when a train receives the confirmation message of the track connection.

Figure 17:
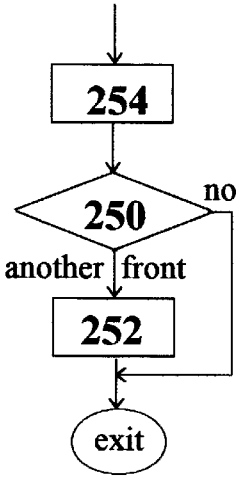

FIG. 17: The process when a train receives the confirmation message of the track connection from a bifurcation.

Figure 18:
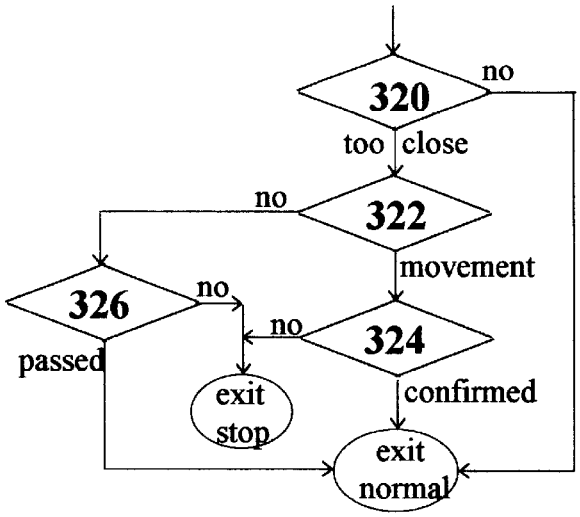

FIG. 18: The process when a train gets its location and velocity while the train is about to pass a bifurcation, a joint, or an intersection.

Figure 19:
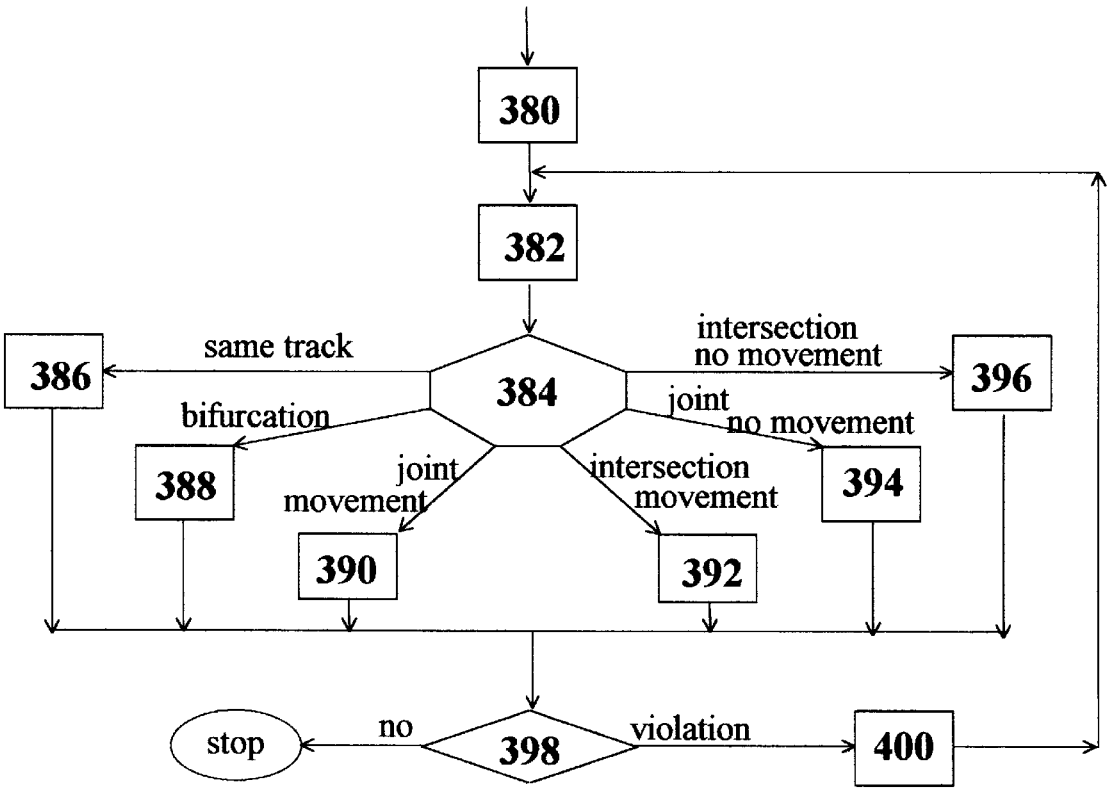

FIG. 19: The method to design the program of each train so that the distance between every two trains is not shorter than the minimum safe distance.

REFERENCE NUMERALS IN DRAWINGS

- 68 The new front train of the rear train of two close consecutive trains.
- 70 The front train of two close consecutive trains.
- 72 The rear train of two close consecutive trains.
- 74 The controller or the control center of the track connection at a bifurcation, at a joint, or at an intersection.
- 172 to 326 The software processes to avoid accidents resulted from that two trains are too close to each other.
- 380 to 400 The processes to design the program of each train.

SUMMARY

The present invention analyzes the mathematical models of the minimum safe distances between two consecutive trains when they are running along the same track and between the rear of two consecutive trains and a bifurcation, a joint, or an intersection when they are about to pass the bifurcation, the joint, or the intersection, respectively. Then, the present invention presents a method to avoid disasters while a train is running by checking if any of the equations are violated at any time. If yes, the train is too close to its front train that the train may hit the front train if the train front stops abruptly, or to a bifurcation, to a joint, or to an intersection, respectively, that the track may not be ready before the train passes it. The train decelerates to stop to avoid the disasters. Finally, the present invention presents a method to design the program of each train according to the traffic requirements that can achieve the maximum capacity of the railroad and guarantee the safety. Since each train or its controller knows what and how the front trains intend to run and how the bifurcation, the joint, and the intersection that the train is about to pass intends to connect the track, the train can determine if an accident may happen and take actions to avoid it.

1. Description—Devices, Apparatuses, and Software to be Installed

The present invention requires that devices, apparatuses, and software are installed to perform the following:

a) Each train is sent the following information in advance:
   - the starting time, the location, the velocity, the acceleration, and the length of each time segment in which the train should run;
   - the starting time, the location, the velocity, the acceleration, and the length of each time segment in which the neighbor of the train will run when the neighbor will be close to the train; and
   - the time, the location, the velocity, and the acceleration of the train when the train will pass which and what kind of bifurcation, joint, and intersection.

b) While a train is running, it performs the following functions periodically:
   - to detect its location and velocity;
   - to estimate how long to pass the next bifurcation, joint, and intersection, respectively; and
   - to send the above information to trains close to and behind it.

c) The controller of each bifurcation, joint, and intersection, respectively, that has mechanical movement performs the following functions:
   - to be sent the sequence or the time when which train will pass it from which track to which track;
   - to always connect the track to let the next train pass;
   - to detect which train passes it; and
   - to communicate with each train that is about to pass it to let the train knows the connection status of the track.

The above are not difficult to be implemented. Most of them have been implemented in the current railroad systems. In the following, if two trains consecutively pass a bifurcation, a joint, or an intersection, respectively, the train that pass earlier is referred as the front train and the other is referred as the rear train regardless what their positions before and after they pass the bifurcation, the joint, or the intersection, respectively.

2. Operation—Receiving a Message from the Front Train

If a train stops abnormally because of an accident, the train next to it should not hit it. The deceleration of a train due to a fatal accident can be large. The maximum deceleration of a train due to an accident depends on the system and different locations. It can be reasonably set to be the largest possible value. If it cannot be determined, assume the worst case and set the deceleration to be infinity. Hence, it is known. Call it accident deceleration and use $b_a$ as the symbol. Different kinds of trains may have different $b_a$. Let $V_{x,t}$ be the velocity of the train X at time t. $L_{x,t}=V_{x,t}^2/2b_a$ is the distance to stop of the train X that the train X will run from it starts to decelerate with $b_a$ at time t to it stops totally. For the worst case, $L_{x,t}$ is zero. When a train determines that accidents occur ahead, it needs to decelerate to stop. Since accidents will not occur often, the deceleration can be larger than the normal deceleration to stop at stations. Call this deceleration abnormal deceleration and use $b_b$ as its symbol. $b_b<=b_a$. Different kinds of trains may have different $b_b$. Let $B_{x,t}=V_{x,t}^2/2b_b$. $B_{x,t}$ is the distance to stop of the train X that the train X will run from it starts to decelerate with $b_b$ at time t to it stops totally when it wants to avoid being involved in the accidents ahead. Both $b_b$ and $b_a$ of each train are known to the public.

When a train is involved in any accident and needs to stop, it sends messages to the trains behind it to let them stop. However, the train may lose ability to send the message and the messages may be lost. Therefore, each train sends a message to trains close to and behind it periodically. When the rear of two consecutive trains receives a normal message from the front train, it knows that the front train is normal up to the moment when the message is sent. The rear train assumes that an accident occurs to the front train right after the front train sends the message. So, the rear train decelerates to stop if it misses messages from the front train for $t_m$ amount of time. $t_m$ cannot be shorter than the longest possible time between two consecutive messages that are received by the rear train and are sent by the front train. $t_m$ of each train is known to the public.

If the rear train receives the normal messages regularly from the front train, it checks if it is too close to the front train or to the bifurcation, the joint, or the intersection ahead. This is done by evaluating equations and checking if the result is less than a pre-defined value $d_s$. If yes, it decelerates to lengthen the distance to the front train to prevent from the possible disaster. Otherwise, it continues to run with its plan. The flowchart in FIG. 2 shows the processes to be done when the rear 72 of two consecutive trains receives a message from the front 70. It first checks if it is instructed to stop in the process 172. If yes, it decelerates to stop until it is instructed to resume the mission. Otherwise, it determines what situation it is in the process 174 and performs the associated job. The processes 176, 178, 180, 182, 184, and 186 to be done under different situations are explained below. After that, for all cases, the process 202 checks the result of the evaluations in the process. If the result of any equation is smaller than $d_s$, the rear train 72 starts to decelerate to stop. Otherwise, it continues to run normally. Normally, the rear train 72 will receive the next message from the front train within $t_m$ amount of time. So, the rear train 72 will continue to run.

2.1 Operation—Avoiding Hitting the Front Train

Figure 3:
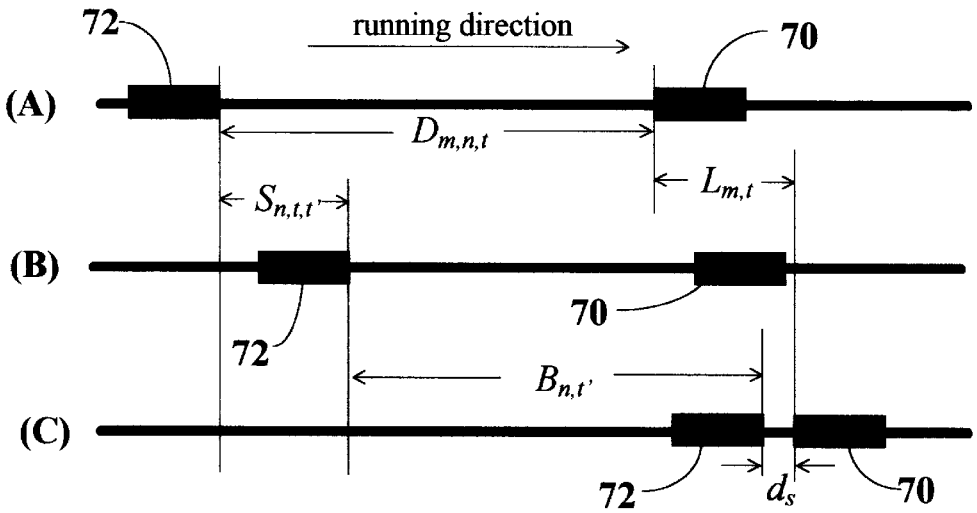

FIG. 3 shows that two consecutive trains are running along the same track and the front train 70 stops abnormally first and then the rear 72 train stops and does not hit the front train. Assume that the rear train 72 receives the last message from the front train 70 at time t and $L_{m,t}=V_{m,t}^2/2b_a$ is the distance to stop with accident deceleration of the front train 70 at time t as shown in FIG. 3A. The delay from when the front train 70 sends the message to when the rear train 72 receives the message is usually much smaller than the deviation of the time for mechanical movement. It is negligible. However, in the case that it is not negligible, the following equations can be modified easily to include the delay where the message is sent at t"=t−p.

Since the message includes the location and the velocity of the front train 70, the rear train 72 can check if $D_{m,n,t}$, the distance between the front train 70 and the rear train 72 at time t, is safe. After the rear train 72 misses messages from the front train 70 for $t_m$ amount of time, the rear train 72 starts to decelerate at time $t'=t+t_m+\sigma$ where $\sigma>=0$ is the human reaction time. $\sigma=0$ if human drivers are not involved. If the human drivers fail to react in $\sigma$, the train decelerates to stop automatically. The distance that the rear train 72 will run from time t to time t' is $S_{n,t,t'}$ as shown in FIG. 3B. Since how the rear train 72 will run is known, $S_{n,t,t'}$ can be calculated. For example, if the accelerations and the decelerations of a train are constant, the time period from t to t' can be divided into K segments $T_k$ where k is from 1 to K, $T_k$ is from time $t_{k-1}$ to time $t_k$, $t_0=t$, and $t_k=t'$. The rear train 72 has constant acceleration in each time segment. Note that constant velocity and constant location also have constant acceleration. Let $a_{n,i}$ be the acceleration of the rear train 72 in time segment $T_i$ and $V_{n,ti}$ be the velocity of the rear train 72 at time $t_i$. If the rear train 72 decelerates, $a_{n,i}$ is negative. If the rear train 72 keeps constant speed, $a_{n,i}$ is 0. $S_{n,t,t'}$ is between $W_{n1}$ and $W_{n2}$ as shown in FIG. 3B and is as follows:

$$S_{n,t,t'} = \sum_{t=1}^{K}\left(V_{n,ti-1}(t_i - t_{i-1}) + \frac{1}{2}a_{n,i}(t_i - t_{i-1})^2\right) \quad (A)$$

$$\text{where } V_{n,ti} = V_{n,ti-1} + a_{n,i}(t_i - t_{i-1})$$

$V_{n,t0}$ is known. $S_{n,t,t'}$ can be computed. Let $L_{m,t}=V_{m,t}^2/2b_a$ be the distance to stop with accident deceleration of the front train 70 and $V_{m,t}$ be the velocity of the front train 70 when it sends the message at time t. Let $B_{n,t'}=V_{n,t'}^2/2b_b$ be the distance to stop with abnormal deceleration of the rear train 72 at time t' and as shown in FIG. 3C. The equation B must hold when the rear train 72 receives a message from the front train 70 at time t. The rear train 72 will not hit the front train 70.

$$D_{m,n,t}-S_{n,t,t'}-B_{n,t'}+L_{m,t}>=d_s>=0 \quad (B)$$

When the rear train 72 stops totally, the distance between the two trains is at least $d_s$ long. In equation B, the deviations of the parameters are chosen so that $S_{n,t,t'}$ and $B_{n,t'}$ are the maximums and $L_{m,t}$ is the minimum.

Therefore, each train needs to keep a timer $t_m$ for its front train. The process 176 in FIG. 2 represents the job to do for the case that the two trains are running and will run on the same track in the near future. FIG. 4 shows more detailed flowchart of the process 176. The process 200 resets the timer $t_m$ to be the last moment to receive the next message and evaluates the equation B where $S_{n,t,t'}$ is the distance that the rear train 72 will run in $t_m+\sigma$. The process 202 checks the result. If the equation B is smaller than $d_s$, the rear train 72 starts to decelerate to stop. Otherwise, it continues to run normally.

2.2 Operation—Approaching a Bifurcation

Figure 5:
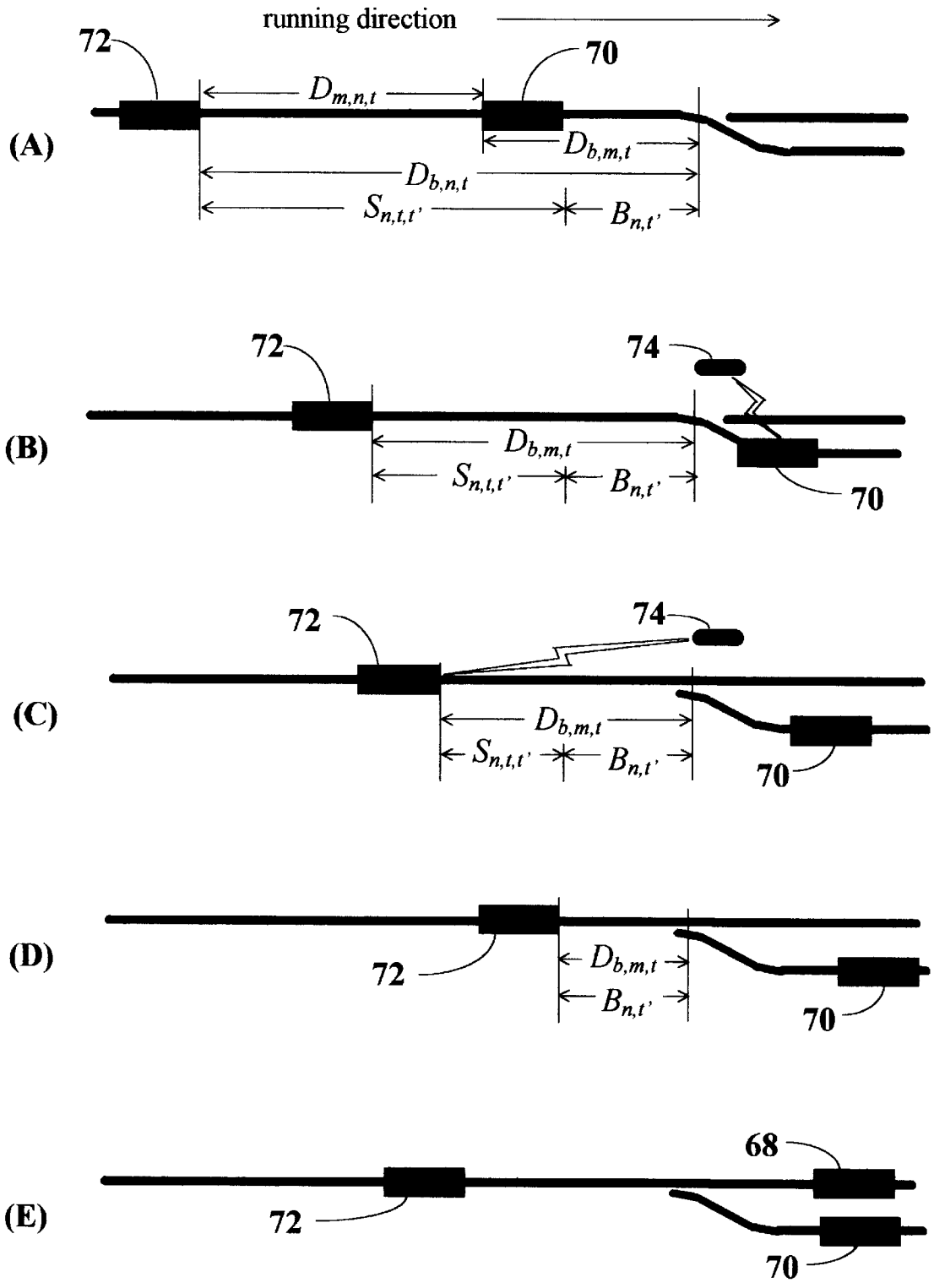

When two consecutive trains on the same track want to get on different tracks after they pass a bifurcation, the track connection needs to be changed after the front train passes it. If the bifurcation fails to do so, the rear train should stop before the bifurcation to avoid accidents. Every two consecutive trains must keep enough distance, $D_{m,n,t}$ not only to prevent from that the rear hits the front but also to let the bifurcation have enough time to change the track connection. FIG. 5A shows that the front train 70 and the rear train 72 are approaching a bifurcation. FIG. 5B shows that the front train 70 passes the bifurcation and the bifurcation controller detects it. FIG. 5C shows that the bifurcation controller sends confirmation of the track connection to the rear train 72. FIG. 5D shows that the bifurcation is at the boundary of the distance to stop of the rear train 72.

Each train knows its location and velocity and the location of the next bifurcation that it is about to pass. The rear train 72 can check if its distance $D_{b,n,t}$ to the bifurcation is close to $B_{n,t}$ its distance to stop as shown in FIG. 5D. If yes and the rear train 72 does not get the confirmation that the track at the bifurcation has connected for it, it decelerates to stop. If human drives the train, $S_{n,t,t'}$ is the distance that the rear train 72 will run from time t to time $t'=t+\sigma$ and $\sigma>=0$ is the human reaction time. Since how the rear train 72 will run is known, the distance $S_{n,t,t'}$ that the rear train 72 will run from time t to time t' can be calculated as above. Then, the equation C should hold.

$$D_{b,n,t}-S_{n,t,t'}-B_{n,t'}>=d_s>=0 \quad (C)$$

When the rear train 72 stops totally, the distance between the rear train 72 and the bifurcation is at least $d_s$ long. $B_{n,t'}$ is the distance to stop of the rear train 72 at time t'. If $\sigma=0$, $S_{n,t,t'}=0$. If the equation C is approaching $d_s$ but the rear train 72 does not get the confirmation, the rear train 72 decelerates to stop.

A better but more complicated way that the rear train 72 can know if it is too close to the bifurcation much earlier is derived as follows. Let the rear train 72 receives the last normal message from the front train 70 at time t as shown in FIG. 5A. Since the message includes the current location and velocity of the front train 70 and the time $r_{pb}$ that the front train 70 will spend to pass the bifurcation, the rear train 72 can know that the front train 70 will pass the bifurcation at the moment $t+r_{pb}$. Let $r_b$ be the summation of the time to change the track connection of the bifurcation and the time for processing and for communicating the messages. In the other words, $r_b$ is the longest possible time from when the front train 70 passes the bifurcation to when the rear train 72 confirms that the track has connected for it. So, the last moment when the rear train 72 should receive the confirmation is at time $t+r_{pb}+r_b$. If the rear train 72 does not receive the confirmation of the track connection by this moment, it starts to decelerate at $t'=t+r_{pb}+r_b+\sigma$ where $\sigma$ is human reaction time. If the human drive the train but fail to react in $\sigma$, the train decelerates to stop automatically. The rear train 72 will stop totally at least $d_s$ distance before the bifurcation. Let $D_{b,n,t}$ be the distance between the head of the rear train 72 and the bifurcation when the rear train 72 receives the message from the front train 70 at time t. The equation C should hold where $S_{n,t,t'}$ is the distance that the rear train 72 will run from time t to time t' and $B_{n,t'}$ is the distance to stop of the rear train 72 with the abnormal deceleration at time t'. There are deviations on the above parameters. In equation C, the parameters are chosen so that $S_{n,t,t'}$ and $B_{n,t'}$ are the maximums. Note that the equation B should hold to prevent from that the rear train 72 hits the front train 70 and the equation C should hold to prevent from that the rear train 72 passes the bifurcation before the bifurcation is ready. If the front train 70 sends a message to the rear train 72 when it passes the bifurcation, as shown in FIG. 5B, the rear train 72 can evaluate the equation C where $S_{n,t,t'}$ is the distance that the rear train 72 will run from time t to time $t'=t+r_b+\sigma$. After the front train 70 but before the rear train 72 passes the bifurcation, the front train 70 may optionally send messages to the rear train 72 and the rear train 72 may optionally check the equation C where $r_{pb}<0$ and $\|r_{pb}\|$ is the time since the front train 70 passes the bifurcation.

The process 178 of the flowchart in the FIG. 2 represents the job to do when the rear train 72 receives a message from the front train 70 while the rear train 72 is about to pass a bifurcation. FIG. 6 shows more detailed flowchart. The process 220 determines if the front train 70 has passed the bifurcation. If not, the process 222 resets the timers $t_m$ and $r_{pb}+r_b$ where $r_{pb}>0$, evaluates the equations B and C where $S_{n,t,t'}$ in the two equations are the distances that the rear train 72 will run in $t_m+\sigma$ and in $r_{pb}+r_b+\sigma$, respectively.

If the front train 70 has passed the bifurcation and the message is the first indicating it, the process 228 resets the timer $r_{pb}+r_b$ where $r_{pb}<=0$, and evaluates the equation C where $S_{n,t,t'}$ is the distance that the rear train 72 will run in $r_{pb}+r_b+\sigma$ and drops front train 70 from the list of consideration. Then, the process 224 determines if there is another front train after the rear train 72 passes the bifurcation. FIG. 5E shows that the train 68 was the immediate front train of the front train 70 before it passed the bifurcation. The train 68 becomes the immediate front train of the rear train 72. If yes, the process 226 changes the new front train 68 to be the immediate front train on the same track and use the associated timer of the new front train 68 if this has not been done, yet, evaluates the equation B where $S_{n,t,t'}$ is the distance that the rear train 72 will run in $t_x+\sigma$ and $t_x$ is the residual time of $t_m$.

2.3 Operation—Approaching a Joint Having Mechanical Movement

Figure 7:
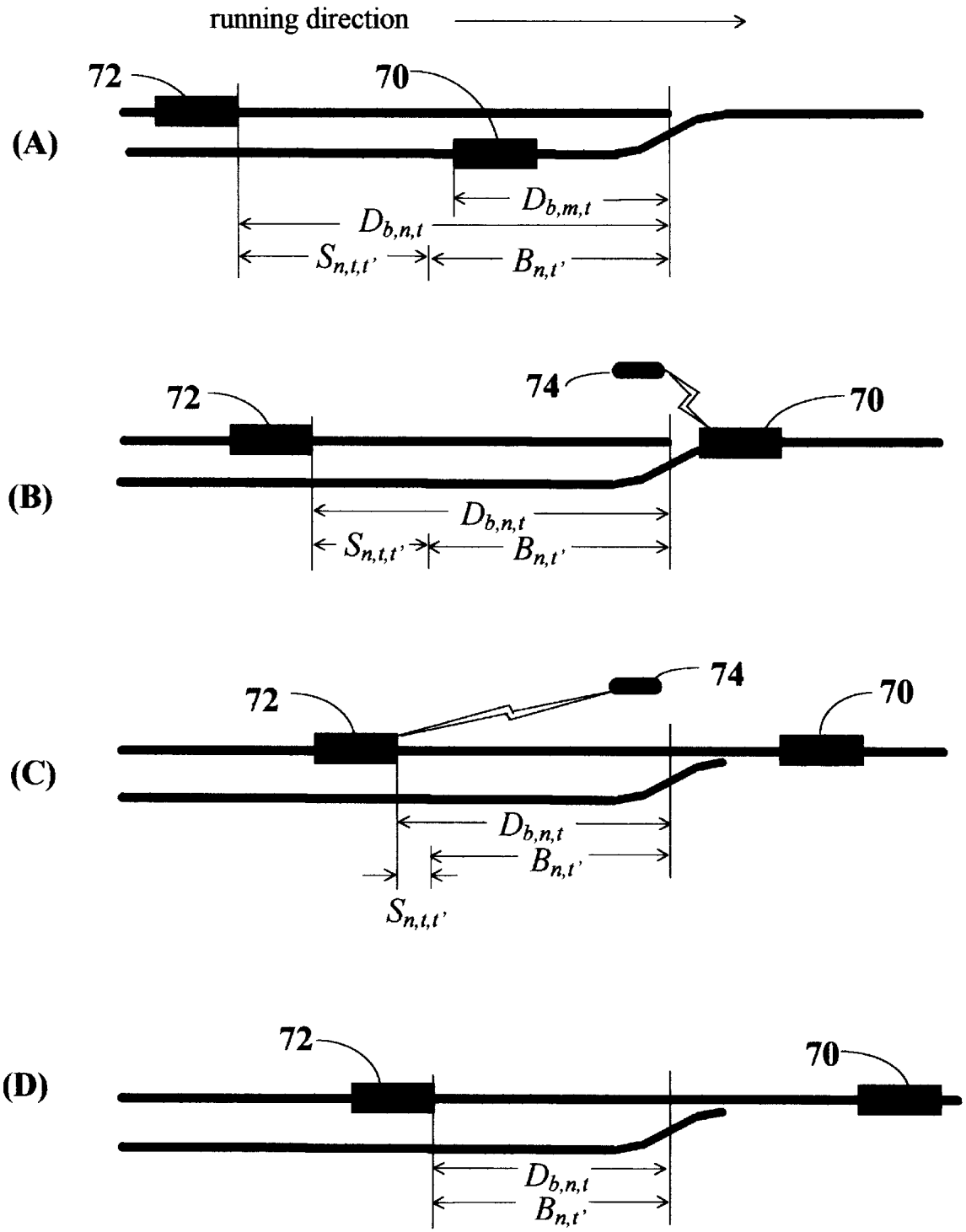

When two trains on different tracks want to get on the same track after they pass a joint that has mechanical movement, the track connection needs to be changed after the front passes the joint. The rear of two consecutive trains should not pass the joint before the track at the joint has connected for it. If the joint fails to do so, the rear train 72 needs to stop before the joint. FIG. 7A shows that the front train 70 and the rear train 72 are approaching a joint. FIG. 7B shows that the front train 70 passes the joint and the joint controller detects it. FIG. 7C shows that the joint controller sends confirmation of the track connection to the rear train 72. FIG. 7D shows that the joint is at the boundary of the distance to stop of the rear train 72.

As shown in FIG. 7D, when the joint is close to the boundary of the distance to stop of the rear train 72, the rear train 72 should have the confirmation that the track at the joint has connected for it. Considering the human reaction time, the equation C should hold when the rear train 72 gets its current location and velocity at time t where $D_{b,n,t}$ is the distance from the joint to the rear train 72 at time t, $S_{n,t,t'}$ is the distance that the rear train 72 will run in human reaction time from time t to time $t'=t+\sigma$, $\sigma=0$ if the train is not driven by the human, and $B_{n,t'}$ is the distance to stop of the rear train 72 at time t'. Since how the rear train 72 will run is known, $S_{n,t,t'}$ can be calculated as above.

A better but more complicated way that the rear train 72 can know if it is too close to the joint much earlier is derived as follows. Assume that the rear train 72 receives the last message from the front train 70 at time t where the distance to the joint is $D_{b,n,t}$ and the distance from the tail of the front train 70 to the joint is $D_{b,m,t}$ as shown in FIG. 7A. The message includes the location and the velocity of the front train 70 and the time $r_{pb}$ that the front train 70 will spend to pass the joint. The rear train 72 can know that the front train 70 will pass the joint at $t_z=t+r_{pb}$. Let $r_b$ be the longest possible time from when the tail of the front train 70 passes the joint to when the rear train 72 confirms that the track has connected for it. The last moment when the rear train 72 should receive the confirmation is at time $t+r_{pb}+r_b$. If the rear train 72 does not receive the confirmation by this moment, it decelerates at time $t'=t+r_{pb}+r_b+\sigma$ where $\sigma$ is human reaction time. If the human drive the train but fail to react in $\sigma$, the train decelerates to stop automatically. Let $S_{n,t,t'}$ be the distance that the rear train 72 will run from time t to time t' and $B_{n,t'}$ be the distance to stop with abnormal deceleration of the rear train 72 at time t'. $S_{n,t,t'}$ and $B_{n,t'}$ can be calculated as stated above. Equation C should hold where the deviations of the parameters are chosen so that $S_{n,t,t'}$ and $B_{n,t'}$ are maximized.

If the front train 70 sends a message to the rear train 72 when it passes the joint, as shown in FIG. 7B, the rear train 72 may check whether the equation C holds with $r_{pb}=0$. After the front train 70 passes the joint, it continues to send messages to the rear train 72. The equation B should hold where $S_{n,t,t'}$ is the distance that the rear train 72 will run from time t to time $t'=t+t_m+\sigma$. The rear train 72 may optionally check the equation C where $r_{pb}<0$ and $\|r_{pb}\|$ is the time since the front train 70 passes the joint.

If the equation C holds before the front train 70 passes the joint, the equation B usually also holds after that. Let the tail of the front train 70 passes the joint at $t=t_z$ as shown in FIG. 7B. $D_{m,n,tz}=D_{b,n,tz}$. The rear train 72 will confirm the track connection no latter than $t_z'=t_z+r_b+\sigma$. For equation C, $D_{m,n,tz}-S_{n,tz,tz'}-B_{n,tz'}=X>=0$ where $S_{n,tz,tz'}$ is the distance that the rear train 72 will run in $r_b+\sigma$ castarting from $t_z$ and $B_{n,tz'}$ is the distance to stop with abnormal deceleration of the rear train 72 at time $t_z'$. Let $t_z''=t_z+t_m+\sigma$. For equation B, $D_{m,n,tz}-S_{n,tz,tz''}-B_{n,tz''}+L_{m,tz}=Y$ where $S_{n,tz,tz''}$ is the distance that the rear train 72 will run in $t_m+\sigma$ starting at $t_z$, $B_{n,tz''}$ is the distance to stop with abnormal deceleration of the rear train 72 at time $t_z''$, and $L_{m,tz}$ is the distance to stop with accident deceleration of the front train 70 at time $t_z$. $r_b$ is time of mechanical movement and $t_m$ is time of electronic action. Usually, $r_b>t_m$. Let $t_x=r_b-t_m$ and $V_{tz''}$ be the velocity of the rear train 72 at $t_z''$. Suppose the rear train 72 has constant acceleration $a_x$ between $t_z$ and $t_z''$. If the train decelerates, $a_x<0$. The case that the rear train 72 has variable acceleration between $t_z$ and $t_z''$ can be derived easily. If the equation C holds, substitute $D_{m,n,tz}$ into equation B as follows:

$$\begin{aligned} Z &= S_{n,tz'',tz'} + B_{n,tz'} + X - B_{n,tz''} + L_{m,tz} \\ &= V_{tz''}t_x + a_x t_x^2/2 + (V_{tz''} + a_x t_x)^2/2b_b - V_{tz''}^2/2b_b + X + L_{m,tz} \\ &= t_x(V_{tz''} + a_x t_x/2)(1 + a_x/b_b) + X + L_{m,tz} \end{aligned}$$

Usually, $\|a_x\|<b_b$. So, $Z>=0$. If $r_b<t_m$ choose $r_b$ to be $t_m$. Then, $Z>0$. Therefore, if the equation C holds the equation B holds when the front train 70 passes the joint.

The process 180 of the flowchart in the FIG. 2 represents the job to do when the rear train 72 receives a message from the front train 70 while the rear train 72 is about to pass a joint having mechanical movement. FIG. 8 shows the more detailed flowchart. The process 242 resets timers $t_m$ and $r_{pb}+r_b$, and evaluates the equation C where $S_{n,t,t'}$ is the distance that the rear train 72 will run in $r_{pb}+r_b+\sigma$. Then, the process 240 determines if the front train 70 has passed the joint. If yes, the process 244 changes the front train 70 to be the front train 70 on the same track and resets and uses $t_m$ as the associated timer if it is not done, yet, and evaluates the equation B where $S_{n,t,t'}$ is the distance that the rear train 72 will run in $t_m+\sigma$.

2.4 Operation—Approaching an Intersection Having Mechanical Movement

The equation C should hold before the front train 70 passes the intersection where $S_{n,t,t'}$ is the distance that the rear train 72 will run from time t when it receives the message to $t'=t+r_{pb}+r_b+\sigma$ and $r_{pb}$ is the time that the front train 70 will spend to pass the intersection and $r_b$ is the time for the intersection to finish the mechanical movement.

The process 182 of the flowchart in the FIG. 2 represents the job to do when the rear train 72 receives a message from the front train 70 while the rear train 72 is about to pass an intersection. The detail is shown in FIG. 9. The process 260 determines if the front train 70 has passed the intersection. If not, the process 262 resets timers $t_m$ and $r_{pb}+r_b$, and evaluates the equation C where $S_{n,t,t'}$ is the distance that the rear train 72 will run in $r_{pb}+r_b+\sigma$ and $r_{pb}>0$. If yes and this is the first message indicating it, the process 264 drops the front train 70 from the list of considering, resets timer $r_{pb}+r_b$, evaluates the equation C where $S_{n,t,t'}$ is the distance that the rear train 72 will run in $r_{pb}+r_b+\sigma$ and $r_{pb}<=0$.

2.5 Operation—Approaching a Joint Having Not Mechanical Movement

Figure 10:
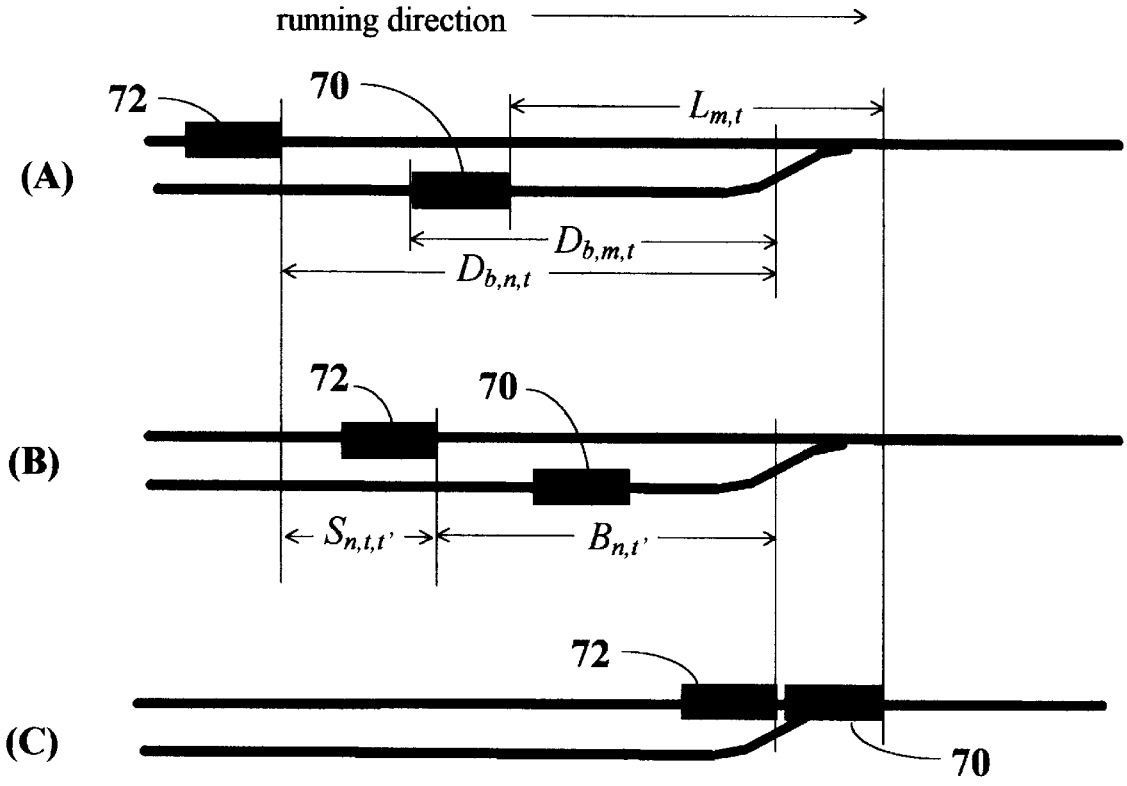
Figure 11:
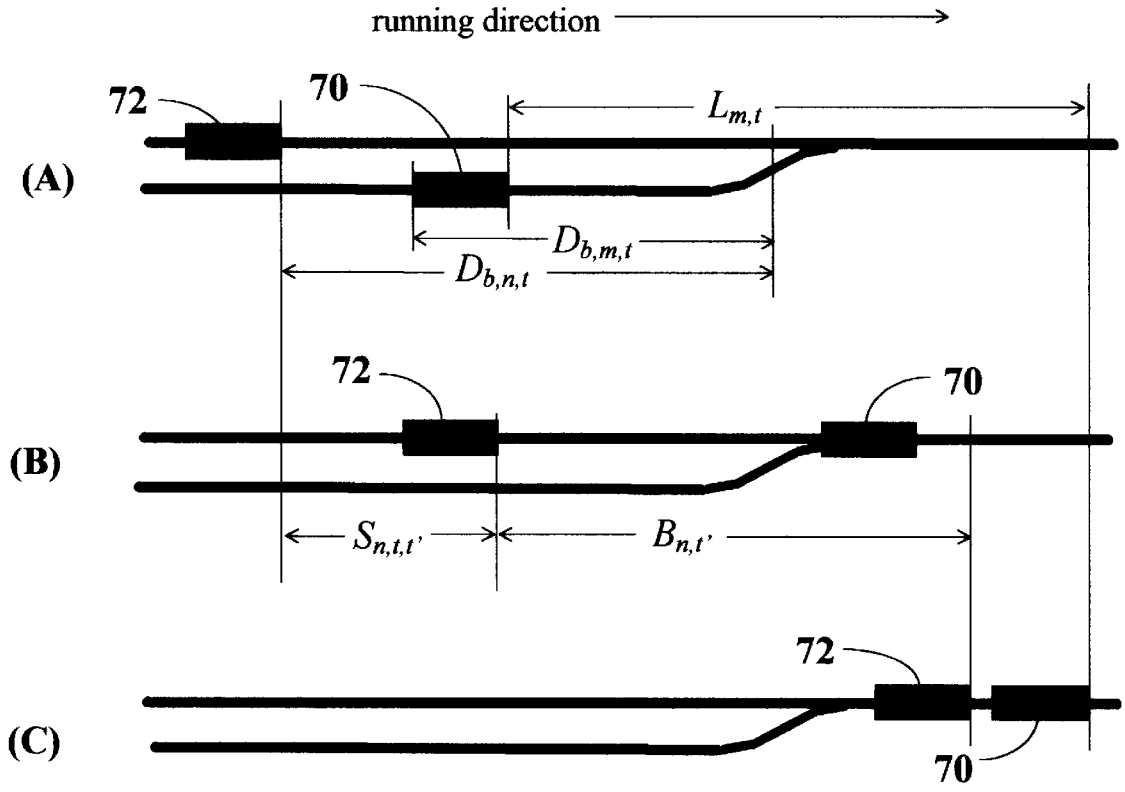

When the front train 70 of two trains passes a track joint that has not mechanical movement, the rear train 72 should not hit the front train 70 no matter what happens. FIG. 10 shows the case that the front train 70 stops at the joint and FIG. 11 shows the case that the front train 70 stops after the joint. When the joint is close to the boundary of the distance to stop of the rear train 72, the rear train 72 should have evidence that the front train 70 has passed the joint. The evidence may be receiving the message that the front train 70 just passed the joint. The evidence may be receiving messages from the front train 70 whose location indicates that the front train 70 has passed the joint. If not, the equation C should hold when the rear train 72 gets its current location and velocity at time t where $D_{b,n,t}$ is the distance from the joint to the rear train 72 at time t, $S_{n,t,t'}$ is the distance that the rear train 72 will run in human reaction time from time t to time $t'=t+\sigma$, $\sigma=0$ if the train is not driven by the human, and $B_{n,t'}$ is the distance to stop of the rear train 72 at time t'. Since how the rear train 72 will run is known, $S_{n,t,t'}$ can be calculated as above.

A better but more complicated way that the rear train 72 can know earlier if it is too close to the joint is derived as follows. Assume that when the rear train 72 receives the last message from the front train 70 at time t, the distance from the head of the rear train 72 to the joint is $D_{b,n,t}$ and the distance from the tail of the front train 70 to the joint is $D_{b,m,t}$ as shown in FIGS. 10A and 11A, respectively. The message includes the time $r_{pb}$ to pass the joint of the front train 70. The rear train 72 knows that the front train 70 will pass the joint at time $t+r_{pb}$. Let $S_{n,t,t'}$ be the distance that the rear train 72 will run from t to $t'=t+r_{pb}+\sigma$, $B_{n,t'}$ be the distance to stop with abnormal deceleration of the rear train 72 at time t', and $L_{m,t}$ be the distance to stop with accident deceleration of the front train 70 at time t. $S_{n,t,t'}$, $B_{n,t'}$, and $L_{m,t}$ can be derived as above. Let $D_{m,n,t}=D_{b,n,t}-D_{b,m,t}$. The following should hold if the rear train 72 receives a message from the front train 70 before the front train 70 passes the joint:

$$D_{b,n,t}-S_{n,t,t'}-B_{n,t'}>=d_s>=0 \text{ AND } D_{b,m,t}>=L_{m,t} \text{ OR}$$

$$D_{m,n,t}-S_{n,t,t'}-B_{n,t'}+L_{m,t}>=d_s>=0 \text{ AND } L_{m,t}>D_{b,m,t}$$

If $D_{b,m,t}>=L_{m,t}$ the joint will be in the middle of or in front of the front train 70 if the front train 70 starts to decelerate at time t. The rear train 72 will stop at least $d_s$ distance before the joint and will not hit the rear train 72 if the rear train 72 starts to decelerate to stop at time $t'=t+r_{pb}+\sigma$ as shown in FIG. 10C. Note that this is the equation C where $S_{n,t,t'}$ is the distance that the rear train 72 will run from t to t'. If $L_{m,t}>D_{b,m,t}$ then $L_{m,t}-D_{b,m,t}$ is the distance from the joint to the tail of the front train 70 when the train totally stops if the train starts to decelerate at time t. The rear train 72 will stop at least $d_s$ distance before the front train 70 and will not hit the front train 70 if the rear train 72 starts to decelerate to stop at time $t'=t+r_{pb}+\sigma$ as shown in FIG. 11C. Note that this is the equation B where $S_{n,t,t'}$ is the distance that the rear train 72 will run from t to $t'=t+r_{pb}+\sigma$. After the front train 70 passes the joint, the messages it sends may or may not include $r_{pb}$.

After the front train 70 passes the joint, the equation B should hold where $S_{n,t,t'}$ is the distance that the rear train 72 will run from t to $t'=t+t_m+\sigma$ and $B_{n,t'}$ is the distance to stop with abnormal deceleration of the rear train 72 at time t'. $S_{n,t,t'}$ and $B_{n,t'}$ can be derived as above. So, if $r_{pb}>=t_m$, $t'=t+r_{pb}+\sigma$. If $r_{pb}<t_m$, $t'=t+t_m+\sigma$. However, if the message that the front train 70 passes the joint is also sent to the rear train 72, the turning point can be when the front train 70 passes the joint.

When the rear train 72 receives a message from the front train 70, the process 184 of the FIG. 2 performs the job. The FIG. 12 shows more detail flowchart. The process 270 determines what is the condition. If $D_{b,m,t}>=L_{m,t}$, the process 272 resets the timers $r_{pb}$ and $t_m$, and evaluates the equation C where $S_{n,t,t'}$ is the distance that it will run from time t to $t'=t+r_{pb}+\sigma$. If $D_{b,m,t}<L_{m,t}$ and $r_{pb}>=t_m$, the process 276 resets the timers $r_{pb}$ and $t_m$, and evaluates the equation B where $S_{n,t,t'}$ is the distance that it will run from time t to $t'=t+r_{pb}+\sigma$. If $D_{b,m,t}<L_{m,t}$ and $r_{pb}<t_m$, including $D_{b,m,t}<=0$ and $r_{pb}<=0$, the process 274 resets the timer $t_m$, evaluates the equation B where $S_{n,t,t'}$ is the distance that it will run from time t to $t'=t+t_m+\sigma$, and changes the front train 70 to be the front train on the same track if this is not done, yet. If the message that the front train 70 passes the joint is also sent to the rear train 72, the process 270 may check if the front train 70 has passed the joint to determine the process 276 or the process 274 to run.

2.6 Operation—Approaching an Intersection Having Not Mechanical Movement

The case that the rear train 72 is about to pass an intersection that has not mechanical movement is the same as the case of passing a joint before the front train 70 passes the intersection. After that, the rear train 72 may drop the front train 70 from the list of consideration.

3. Operation—Receiving the Message that the Front Train Just Passed

If the information that the front train 70 passes a bifurcation, a joint, or an intersection is detected by apparatus other than the front train 70 and is also sent to the rear train 72, the rear train 72 may check if it is too close to the bifurcation, the joint, or the intersection, respectively. If yes, it decelerates to stop. FIG. 13 shows the flowchart of the process. The process 172 first checks if it is instructed to stop. If yes, it decelerates to stop. Otherwise, the process 302 determines what is to pass. If the front train 70 passes a bifurcation, the job is represented as the process 304 in FIG. 13. FIG. 14 shows more detailed flowchart. The processes 224, 226, and 228 are the same as the processes in FIG. 6 when the rear train 72 receives a message from the front train 70 where $r_{pb}0$. They are explained in section 2.2. If the front train 70 passes a joint having mechanical movement, the job is represented as the process 306 in FIG. 13. FIG. 8 also shows more detailed flowchart for this case where $r_{pb}=0$. The processes 240, 242, and 244 are explained in section 2.3. If the front train 70 passes an intersection having mechanical movement, the job is represented as the process 308 in FIG. 13. FIG. 9 also shows more detailed flowchart for this case where $r_{pb}=0$. The processes 260, 262, and 264 are explained in section 2.4. If the front train 70 passes a joint having not mechanical movement, the job is represented as the process 310 in FIG. 13. FIG. 15 shows more detailed flowchart where $r_{pb}=0$. The process 274 is explained in section 2.5. If the front train 70 passes an intersection having not mechanical movement, the job is represented as the process 312 in FIG. 13. The rear train 72 may drop the front train 70 from the list of consideration.

For all cases, the process 202 checks the evaluation result. If the result of any equation is smaller than $d_s$, the rear train 72 starts to decelerate to stop. Otherwise, it continues to run normally.

4. Operation—Receiving Confirmation of Track Connection

FIG. 16 shows the job to be done when the rear train 72 receives the confirmation of the track connection from the controller of the bifurcation, the joint, or the intersection that has mechanical movement. If the confirmation is from a bifurcation, the job is represented as the process 232 in FIG. 16. FIG. 17 shows more detailed flowchart for this case. The process 254 drops the bifurcation from the list of consideration. Then, the process 250 determines if there is another front train after the rear train 72 passes the bifurcation as shown in FIG. 5E. If yes, the process 252 changes the new front train 68 to be the immediate front train on the same track and use the associated timer of the new front train 68 if this is not done, yet, and optionally evaluates the equation B where $S_{n,t,t'}$ is the distance that the rear train 72 will run in $t_x+\sigma$ and $t_x$ is the residual time of $t_m$.

If the confirmation is from a joint having mechanical movement, the job is represented as the process 234 in FIG. 16. It changes the front train 70 to be the front train on the same track and resets and uses $t_m$ as the associated timer if it is not done, yet, optionally evaluates the equation B where $S_{n,t,t'}$ is the distance that the rear train 72 will run in $t_x+\sigma$ and $t_x$ is the residual time of $t_m$, and drops the joint from the list of consideration.

If the confirmation is from an intersection having mechanical movement, the job is represented as the process 236 in FIG. 16. It drops the intersection from the list of consideration.

5. Operation—Receiving Information of the Location and the Velocity

When the rear train 72 gets its location and velocity, since it knows the location of the bifurcation, the joint, or the intersection that it is about to pass, it may also checks if it is too close to the bifurcation, the joint, or the intersection, respectively. FIG. 18 shows it. The process 320 determines whether the bifurcation, the joint, and the intersection, respectively, is far from the boundary of its distance to stop plus $d_s$. In the other words, if the equation C holds where $r_{pb}=0$ and $r_b=0$. If yes, the equation C is larger than $d_s$. The rear train 72 continues its plan. Otherwise, the process 322 determines whether the bifurcation, the joint, and the intersection, respectively, has mechanical movement. If yes, the process 324 determines whether the confirmation of the track connection has been received. If yes, the rear train 72 continues its plan. Otherwise, the rear train 72 decelerates to stop. If the bifurcation, the joint, and the intersection, respectively, has not mechanical movement, the process 326 determines whether the front train 70 has passed the bifurcation, the joint, and the intersection, respectively. If yes, the rear train 72 continues its plan. Otherwise, the rear train 72 decelerates to stop.

6. Operation—Designing the Program of Each Train

Although each train can assure safety explained above, the train should not frequently decelerate only for safety. The program of each train should be designed to be safe while the distance between two consecutive trains is minimized. Having equations B and C, the program of each train can be determined and none of any two consecutive trains are too close to each other at any time any place. FIG. 19 is a flowchart to design the programs of all trains. In the process 380, the attempted program of each train is designed disregarding other trains according to the traffic. It can be designed starting at a station that the train is intended to arrive at or to depart from the station at specific time and then segment by segment backward to the starting time and station and forward to the end time and destination. The attempted starting time, location, velocity, acceleration, and how long the action of each segment of each train are determined. In each time segment of a train, the train has constant acceleration. For examples, the train accelerates from still at a station to a specific velocity with specific acceleration in a segment. Then, runs with constant speed in the next segment. Then, decelerates to stop at the next station in the next segment. Then, stops at the station to load and to unload passengers in the next segment. For convenience, a segment is divided by the moments when the train passes each bifurcation, each joint, and each intersection, respectively, if there are any.

Then, in the process 382, the time segments are further divided so that every two close trains have constant acceleration in each time segment. For each segment $T_{tp,tq}$ that begins at $t_p$ and ends at $t_q$, the locations, the velocities, and the accelerations of the two trains at $t_p$ are known. Let them be $P_{m,tp}$ and $P_{n,tp}$, $V_{m,tp}$ and $V_{n,tp}$, and $a_{m,tp}$ and $a_{n,tp}$, respectively, where m refers to the front train and n refers to the rear train. Negative acceleration means deceleration and zero acceleration means constant speed. Also, let $P_b$ be the location of the bifurcation, the joint, or the intersection, respectively, if the two trains are approaching to it. At t where $t_p<=t<=t_q$, the following hold:

$$D_{m,n,t} = P_{m,t} - P_{n,t} = (P_{m,tp} - P_{n,tp}) + (V_{m,tp} - V_{n,tp})(t - t_p) + \frac{1}{2}(a_{m,tp} - a_{n,tp})(t - t_p)^2 \quad \text{(D)}$$

$$D_{b,m,t} = P_b - P_{m,t} = P_b - P_{m,tp} - V_{m,tp}(t - t_p) - \frac{1}{2}a_{m,tp}(t - t_p)^2 \quad \text{(E)}$$

$$D_{b,n,t} = P_b - P_{n,t} = P_b - P_{n,tp} - V_{n,tp}(t - t_p) - \frac{1}{2}a_{n,tp}(t - t_p)^2 \quad \text{(F)}$$

The process 384 determines what need to be checked for each segment $T_{tp,tq}$. Case 1 is that $T_{tp,tq}$ is when two trains are running and will run on the same track in the near future. The equation B should hold at any time. The process 386 finds the minimum of the equation B. It substitutes the values of the attempted programs into the equation D. $D_{m,n,t}$ is a function of t. Then, substitutes $D_{m,n,t}$ into the equation B. The equation A is re-written as follows:

$$S_{n,t,t'} = \left((V_{n,tp} + a_{n,1}(t - t_p))(t_1 - t) + \frac{1}{2}(a_{n,1}(t_1 - t))^2\right) + \sum_{i=2}^{K-1}\left(V_{n,ti-1}(t_i - t_{i-1}) + \frac{1}{2}(a_{n,i}(t_i - t_{i-1}))^2\right) + \left(V_{n,tK-1}(t + t_m - t_{K-1}) + \frac{1}{2}(a_{n,K-1}(t + t_m - t_{K-1}))^2\right)$$

$S_{n,t,t'}$ is a function of t. $B_{n,t'}=V_{n,t'}^2/2b_b$ where $V_{n,t'}=V_{n,tK-1}+a_{n,K-1}(t+t_m-t_{K-1})$. $B_{n,t'}$ is a function of t. $L_{m,t}=V_{m,t}^2/2b_a$ where $V_{m,t}=V_{m,tp}+a_{m,tp}(t-t_p)$. $L_{m,t}$ is a function of t, too. All of these are substituted into the equation B. Then, the equation B has a single variable t. The process 386 finds the minimum of the equation B in $T_{tp,tq}$.

Case 2 is that $T_{tp,tq}$ is when the rear of two trains is approaching a bifurcation, the front is approaching or just passed the bifurcation, and they will get on different tracks after they pass the bifurcation. The equation B should hold before the front train passes the bifurcation. The equation C should hold before the rear train passes the bifurcation where $r_{pb}>0$ before the front train passes the bifurcation, $r_{pb}=0$ if the front train just passed the bifurcation, and $r_{pb}<0$ after the front train passes the bifurcation. The process 388 finds the minimum of the equation B if the time segment $T_{tp,tq}$ is before the front train passes the bifurcation and the minimum of the equation C if the time segment $T_{tp,tq}$ is before the rear train passes the bifurcation. The $S_{n,t,t'}$ of the equation C is a function of t as follows where $t'=t_K$.

$$S_{n,t,t'} = \left((V_{n,tp} + a_{n,1}(t - t_p))(t_1 - t) + \frac{1}{2}(a_{n,1}(t_1 - t))^2\right) + \sum_{i=2}^{K}\left(V_{n,ti-1}(t_i - t_{i-1}) + \frac{1}{2}(a_{n,i}(t_i - t_{i-1}))^2\right)$$

$B_{n,t'}=V_{n,t'}^2/2b_b$ where $V_{n,t'}=V_{n,tK}$. $B_{n,t'}$ is a constant term in the equation C because the velocity at t' is known. Then, the equation C has a single variable t.

Case 3 is that $T_{tp,tq}$ is when the rear of two trains is approaching a joint that has mechanical movement, the front is approaching or just passed the joint, and they will get on the same track after they pass the joint. The equation C should hold if $T_{tp,tq}$ is before the track is ready for the rear train. The equation B should hold if $T_{tp,tq}$ is after that. The process 390 finds the minimum of either equation in $T_{tp,tq}$.

Case 4 is that $T_{tp,tq}$ is when two trains are approaching an intersection that has mechanical movement from different tracks. The equation C should hold if $T_{tp,tq}$ is before the track is ready for the rear train. The process 392 finds the minimum of the equation C in $T_{tp,tq}$.

Case 5 is that $T_{tp,tq}$ is when the rear of two trains is approaching ajoint that has not mechanical movement, the front is approaching or just passed the joint, and they will get on the same track after they pass the joint. The equation C should hold if $T_{tp,tq}$ is before the rear train passes the joint. The equation B should hold if $T_{tp,tq}$ is after that. The process 394 finds the minimum of either equation in $T_{tp,tq}$.

Case 6 is that $T_{tp,tq}$ is when two trains are approaching an intersection that has not mechanical movement from different tracks. The equation C should hold if $T_{tp,tq}$ is before the front train passes the intersection. The process 396 finds the minimum of the equation C in $T_{tp,tq}$.

Then, the process 398 checks if any of the equations are violated. If yes, the two trains are closer than the minimum safe distances. The attempted programs of either or both trains are modified in the process 400. Any combination of the following can be applied to do so:

1) Delay the starting time of the mission of one train.

2) Lengthen the stopping time of one train at one or more stations where the train stops previously.

3) One train slows down at appropriate place.

4) Start the mission of one train earlier.

5) Shorten the stopping time of one train at one or more stations where the train stops previously.

6) One train runs faster at appropriate place.

Applying item 1, 2 or 3 to the rear train or applying item 4, 5 or 6 to the front train will lengthen the distance and the time between the two trains so that the equations hold. If the front train needs to yield the rear, applying item 1, 2 or 3 to the front train or applying item 4, 5 or 6 to the rear train may make the front train be the rear. However, applying item 6 may make the train run with abnormally high speed or acceleration. Multiple solutions may be applied to solve the problem. Which ones are selected to solve the problem depends on the situation. However, applying these methods to make the equations hold in $T_{tp,tq}$ may make some equations not hold in some time segments of other pairs of trains. Therefore, the whole process loops until no pair of consecutive trains are too close to each other at any time.

There are many factors that may make the trains bias from their programs. If a train lags behind its regular schedule, it may affect the trains behind it and some equations may not hold. The programs of the trains behind the train that lags may need to be modified. The same method can be applied to do so.

CONCLUSION, RAMIFICATIONS, AND SCOPE

Accordingly, the readers will see that the disclosure of this invention can minimize the distance between every two consecutive trains in a railroad system and assures that the following disasters will not happen:

a train hits another train; and a train runs over a bifurcation, a joint, or an intersection, respectively, that is not ready for the train.

The capacity of the railroad can be maximized. Different kinds of trains can run on the same railroad. The program of each train can be designed so that, under normal situation, no trains will be too close to others. Hence, some railroads can be saved.

Although the description above contains many specifications, these should not be construed as limiting the scope of the invention but as merely providing illustrations of some of the presently preferred embodiments of this invention. The following explains some examples.

The devices, apparatuses, and software to detect the location, the velocity, and the acceleration of each train can be installed in each train, along the railroad, in the air, or in satellites, or partially installed in each train, partially installed along the railroad, and partially installed in the air or in the satellites. Then, the information is forwarded to each train. Each train performs the same job as explained above.

The devices, apparatuses, and software to detect the event that a train passes a bifurcation, ajoint, and an intersection, respectively, can be installed in each train, by the bifurcation, by the joint, and by the intersection, respectively, in the air, in satellites, or partially installed in each train, partially installed by the bifurcation, by the joint, and by the intersection, respectively, and partially installed in the air or in the satellites. The message of the event is forwarded to the controller of the bifurcation, the joint, and the intersection, respectively, so that the controller can issue commands to change the connection of the track. Optionally, the message can also be forwarded to the trains that are about to pass the bifurcation, the joint, and the intersection, respectively, to let the trains check if they are too close to the bifurcation, to the joint, or to the intersection, respectively.

Furthermore, the information of the location, the velocity, and the acceleration of each train, the program of each train, the event that a train passes a bifurcation, a joint, and an intersection, respectively, and the confirmation of the track connection at each bifurcation, at each joint, and at each intersection, respectively, can be sent to the monitor and control center of the trains instead of being sent to the trains. Then, the center performs the tasks of the trains explained above and instructs the trains how to run and to prevent from possible disasters. The center may be distributed into several local monitor and control centers. Then, the above information in an area is forwarded to the center of that area and the center performs the same job as above.

When a train is about to pass a bifurcation, a joint, or an intersection, respectively, it sends the time $r_{pb}$ it needs to spend to pass the bifurcation, the joint, or the intersection, respectively, to the next train to pass the bifurcation, the joint, or the intersection, respectively. After $t_m$, the train sends the message again with $r_{pb}-t_m$. Meanwhile, the associated timer in the next train also elapses $t_m$ amount of time. Therefore, the next train may reset the associated timer only when the received information does not consistent with the associated timer.

The time delay ρ from when a message is sent to when a message is received is short. This electronic delay time usually is much shorter than the deviation of the time for mechanical movement. Therefore, the equations derived above neglect the electronic delay. However, in the case that the delay is not negligible, the equations can be easily modified to include the delay. The message received by the receiver at time t is sent by the sender at time $t''=t-\rho$. The distance between the front and the rear train 72s at time t in the equations is changed to be the distance between the tail of the front train 70 at time t" and the head of the rear train 72s at time t. Then, use $t+r_{pb}-\rho+r_b+\sigma$, $r_{pb}-\rho+r_b+\sigma$, and $r_b-\rho+\sigma$ instead of $t+r_{pb}+r_b+\sigma$, $r_{pb}+r_b+\sigma$, and $r_b+\sigma$, respectively, in the equations.

The minimum safe distances between two trains under different situations can be calculated before the system starts. The minimum safe distances can be stored in a device. Then, instead of calculating the minimum safe distances dynamically, each train or the control center of each train may retrieve the minimum safe distances from the database.

The flowcharts are merely used to explain what jobs to be done and to show that the present invention can be implemented. There are many topologically equivalent flowcharts.

Thus the scope of the invention should be determined by the claims and their legal equivalents, rather than by the examples given.

I claim:

1. A railroad transportation system to allow minimum distance between two consecutive trains and to assure that no disasters will result from that the distance between two consecutive trains is too short, comprising the following where the controller of a train can be in said train or in the monitor and control center of said train and the controller of a bifurcation, a joint, or an intersection, respectively, can be stand-alone or in the monitor and control center of said bifurcation, said joint, or said intersection, respectively:

a) installing means to detect the location, the velocity, and, optionally, the acceleration of each train and forwarding the information to the controller of said train;

b) installing a controller for each bifurcation, joint, and intersection, respectively, that has mechanical movement to connect the track at said bifurcation, said joint, and said intersection, respectively, to let the next train pass according to the program that each said controller receives;

c) installing means to do the following for each bifurcation, joint that has mechanical movement, and intersection that has mechanical movement, respectively:

detecting that a train passes said bifurcation, said joint, and said intersection, respectively;

forwarding the detecting result to the controller of said bifurcation, said joint, and said intersection, respectively, so that said controller changes connection of the track to let the next train pass;

optionally, forwarding said detecting result to the controllers of trains that are about to pass said bifurcation, said joint, and said intersection, respectively; and doing either one or both of the following:

⟹sending the status of the track connection at said bifurcation, said joint, and said intersection, respectively, to the controllers of the trains that are about to pass said bifurcation, said joint, and said intersection, respectively; or ⟹storing said status in a device so that the controller of each train that is about to pass said bifurcation, said joint, and said intersection, respectively, retrieve said status from said device;

d) sending the controller of each train the following information in advance:

the time segments of when, where, and how said train should run in each time segment;

the time segments of when, where, and how another train will run where said another train will be close to said train in said time segments and said another train will run over some points where said train will run over at later time; and when, where, and how said train will pass which and what kind of bifurcation, joint, and intersection, respectively;

so that said controller of said train knows when, where, and how to check if said train is too close to which train, to which bifurcation, to which joint, or to which intersection, respectively;

e) sending the controller of each bifurcation, each joint having mechanical movement, and each intersection having mechanical movement, respectively, when or the sequence of and how which train will pass so that said controller knows when and how to connect the track for which train;

f) sending a message including the following list of information of each train periodically to the controllers of the neighbors where said neighbors are trains close to said train and said neighbors will pass some points where said train is currently passing or will pass before said neighbors in the near future:

the current location;

the velocity or the distance to stop;

how long to pass the next bifurcation if said train is about to pass said bifurcation;

optionally, how long since passing the previous bifurcation if said train just passed said bifurcation;

how long to pass the next joint if said train is about to pass said joint;

how long since passing the previous joint if said train just passed said joint;

how long to pass the next intersection if said train is about to pass said intersection; and optionally, how long since passing the previous intersection if said train just passed said intersection;

so that the controller of the first train of said neighbors can check if said first train is too close to said train, to said bifurcation, to said joint, or to said intersection, respectively;

g) having a train decelerate to stop if any of the following hold:

said train receives a message that instructs said train to stop;

said train has not, yet, but should have received a message from a close neighbor that said neighbor will run over some railroad points where said train will run over later; or said train has not, yet, but should have received confirmation that the track at the bifurcation, at the joint, or at the intersection, respectively, that said train is about to pass is ready for said train;

h) doing the following in the controller of a train when the controller of said train receives a message from the controller of a close immediate front neighbor and said two trains are running and will run on the same track in the near future:

checking if the distance between said two trains is shorter than the minimum safe distance, and, if yes, having said train decelerate to stop; and resetting the timer when to receive the next message from said neighbor;

i) having the controller of a train do the following when the controller of said train receives a message from the controller of a close front neighbor 1) while said train and said neighbor are running on the same track and will get on different tracks after they pass a bifurcation and said neighbor will pass said bifurcation before said train; 2) while said train and said neighbor are running on different tracks and will get on the same track after they pass a joint and said neighbor will pass said joint before said train; or 3) while said train and said neighbor are running on different tracks and will get on different tracks after they pass an intersection and said neighbor will pass said intersection before said train:

having said train decelerate to stop if the distance between said two trains is shorter than the minimum safe distance and said two trains are about to pass said bifurcation or if the distance between said train and said bifurcation, said joint, or said intersection, respectively, is shorter than the minimum safe distance; and resetting the timer when to receive the next message from said neighbor and the timer when to receive the confirmation of track connection at said bifurcation, said joint, or said intersection, respectively, that has mechanical movement;

j) having the controller of a train do the following that have not been done, yet, 1) when the controller of said train receives a message from the controller of a neighbor while said train is about to pass a bifurcation that said neighbor just passed and said two trains will get on different tracks; or 2) when the controller of said train receives a message indicating that said neighbor just passed said bifurcation and said two trains will get on different tracks:

having said train decelerate to stop if the distance between said train and said bifurcation is shorter than the minimum safe distance; and starting tracing the new close front neighbor if said new neighbor is on the track that said train is about to get on and is close to said train and having said train decelerate to stop if the distance between said train and said new neighbor is shorter than the minimum safe distance;

k) having the controller of a train do the following that have not been done, yet, 1) when the controller of said train receives a message from the controller of a neighbor while said train is about to pass a joint or an intersection that said neighbor just passed from different track; or 2) when the controller of said train receives a message indicating that said neighbor just passed said joint or said intersection, respectively, from different track:

having said train decelerate to stop if the distance between said train and said joint or said intersection, respectively, is shorter than the minimum safe distance or if the distance between said train and said neighbor is shorter than the minimum safe distance;

resetting the timer when to receive the next message from said neighbor and the timer when to receive the confirmation of track connection at said joint or said intersection, respectively, that has mechanical movement and the controller of said train has not receive said confirmation, yet;

changing said neighbor to be the front neighbor on the same track if said train is about to pass said joint;

l) having a train continue to run when the controller of said train receives or retrieves a message of confirmation that the track at the bifurcation, at the joint, or at the intersection, respectively, having mechanical movement that said train is about to pass has been connected correctly for said train;

m) having a train decelerate to stop when the controller of said train gets the location and the velocity of said train while said train is about to pass a bifurcation, a joint, or an intersection, respectively, that is close to the boundary of the distance to stop of said train and said train has not gotten the confirmation of the track connection if said bifurcation, said joint, or said intersection, respectively, has mechanical movement or said train has not gotten any evidence that the front neighbor, if there is one, has passed said bifurcation, said joint, or said intersection, respectively, if said bifurcation, said joint, or said intersection, respectively, has not mechanical movement; and whereby every train will not hit any other trains;

whereby every train will not run over any bifurcation, joint, or intersection, respectively, that is not ready for said train;

whereby the distances between every two consecutive trains can be minimized and the maximum capacity of the railroad can be achieved;

whereby different train systems may share the same railroad and railroads may be saved; and whereby multiple trains can be arranged to depart from or to arrive at, respectively, the same station so that the volume is large enough to economically arrange buses to carry the passengers from their source places to said station or from said station to their destinations, respectively, or both and each passenger only stops at small number of bus stops.

2. A method to schedule the program of each train to satisfy the traffic requirement that may be the maximum capacity of the railroad and different trains may share the same railroad, comprising the following:

a) making the attempted program of each train according to the traffic requirement where said program is composed of time segments and said train has constant location, constant velocity, or constant acceleration in each segment;

b) dividing the attempted programs of every two close trains that are or will be on the same track in the near future into time segments such that, in each time segment, each of said two trains has constant location, constant velocity, or constant acceleration;

c) deriving the minimum distances of the following in each time segment:

between every two close consecutive trains on the same track; and between each bifurcation, each joint, and each intersection, respectively, and each train if said train is about to pass said bifurcation, said joint, and said intersection, respectively;

d) repeating to apply any combination of the following ways to either one or both of the two consecutive trains in the step c) to change the attempted programs of said trains until said minimum distances in all time segments for all trains are not shorter than the minimum safe distances:

I. delaying the starting time of the mission;

II. lengthening the stopping time at one or more previous stations;

III. slowing down at appropriate place;

IV. starting the mission earlier;

V. shortening the stopping time at one or more previous stations; and

VI. running faster at appropriate place;

whereby maximum capacity of the railroad can be scheduled; and whereby two or more different train systems that share the same railroad may be scheduled.

* * * * *